United States Patent [19]

Gay et al.

[11] 4,182,076

[45] Jan. 8, 1980

[54] ANIMATED DOLL

[75] Inventors: Derek J. Gay, Rancho Palos Verdes; Nicol S. Wilson, Redondo Beach; Roger H. Sweet, Long Beach; Saint E. B. Berford, Lakewood, all of Calif.

[73] Assignee: Mattel, Inc., Hawthorne, Calif.

[21] Appl. No.: 878,856

[22] Filed: Feb. 17, 1978

[51] Int. Cl.[2] ..... A63H 11/00

[52] U.S. Cl. ..... 46/265; 46/121; 46/136

[58] Field of Search ..... 46/118, 120, 136, 121, 46/128, 139, 148, 119, 117, 247

[56] References Cited

U.S. PATENT DOCUMENTS

| | | | |
|---|---|---|---|
| 3,597,878 | 8/1971 | Iwaski et al. | 46/136 X |
| 3,611,625 | 10/1971 | Sloop et al. | 46/121 |
| 3,616,570 | 11/1971 | Groves et al. | 46/120 |
| 3,641,702 | 2/1972 | Gardel et al. | 46/120 |
| 3,648,405 | 3/1972 | Tepper | 46/121 X |
| 3,700,384 | 10/1972 | Gardel et al. | 46/136 |
| 3,994,092 | 11/1976 | Sapkus et al. | 46/119 |

*Primary Examiner*—John F. Pitrelli
*Attorney, Agent, or Firm*—John G. Mesaros; Max E. Shirk; Ronald M. Goldman

[57] ABSTRACT

An animated doll configured in the form of a ballerina having a crown on the head thereof connected to an actuating member on the longitudinal center line of the doll, the other end of the member having a cam. One leg can be detented to a fixed position in vertical alignment with the torso of the doll with the other leg thereof being pivotally coupled to the torso with a crank affixed thereto for co-acting with the cam for causing the leg to kick. The actuating member has a square shaft portion engaging a mating aperture within a drive gear which is driven by a motor fixedly coupled within the torso. Upon holding the crown, the doll rotates and one leg can be pivoted by depressing the crown.

9 Claims, 8 Drawing Figures

ANIMATED DOLL

BACKGROUND OF THE INVENTION

The background of the invention will be discussed in two parts:

1. Field of the Invention

This invention relates to animated dolls and more particularly to a doll in the form of a ballerina which can be rotated with a leg kicking mechanism provided.

2. Description of the Prior Art

Dolls of animated form are very popular with children. As such animated dolls, one or more portions of the anatomy are selectively operable by manual or motor driven means to simulate human movement.

One such doll has been made in the form of a ballerina with a tiara or crown. The crown portion is configured for holding by the child to enable the doll to perform a movement similar to that of a ballet dancer or ballerina. One such doll is shown in U.S. Pat. No. 3,616,570 to Kossoff et al., issued Nov. 2, 1971 entitled "Animated Doll" and assigned to the assignee of the instant invention. Another such ballerina doll is shown and described in U.S. Pat. No. 3,597,878, issued on Aug. 10, 1971 to Iwasaki, et al., entitled "Animated Toy", such patent likewise being assigned to the assignee of the instant invention. In the doll of the latter patent, a multi-position switch actuated from the doll's exterior by means of a control knob preferably located on the doll's head controls operation of the doll in one of two modes. In a first switch position, a drive means within the torso is repeatedly coupled to a first step-controlling assembly which is coupled to the doll's leg to transmit linear motion thereto to provide a walking or stepping motion. In a second position of the switch, a second step-controlling assembly becomes engaged causing the doll's body to rotate to simulate a pirouette.

It is an object or the present invention to provide a new and improved animated doll.

It is another object of the present invention to provide a ballerina doll having an uncomplicated construction to enable the doll to pirouette and to enable the user to actuate a leg kicking mechanism during the rotation or with the rotating means inactivated.

SUMMARY OF THE INVENTION

The foregoing and other objects of the invention are accomplished by providing a doll having an actuating member reciprocably mounted on the longitudinal center line thereof, with one end of the actuating member extending externally of the doll for receiving a control knob configured in a form to simulate a portion of a crown. A drive assembly is fixedly mounted within the torso of the doll with a drive gear having a square opening receiving a square or splined shaft portion of the actuating member for enabling the doll to be rotated about the toe of one leg with a knob manually held in position. The other end of the actuating member receives a cam which co-acts with a crank upon depression thereof, the crank being coupled for pivoting the other leg of the doll in response to depression of the actuating member. The first leg is mounted with a detent sleeve to fixedly position the leg about which the doll rotates relative to the torso in general alignment on a vertical plane with the longitudinal center line of the doll.

Other objects, features and advantages of the invention will become apparent from a reading of the specification when taken in conjunction with the drawings in which like reference numerals refer to like elements in the several views.

DESCRIPTION OF THE PREFERRED EMBODIMENT

Figure 1:
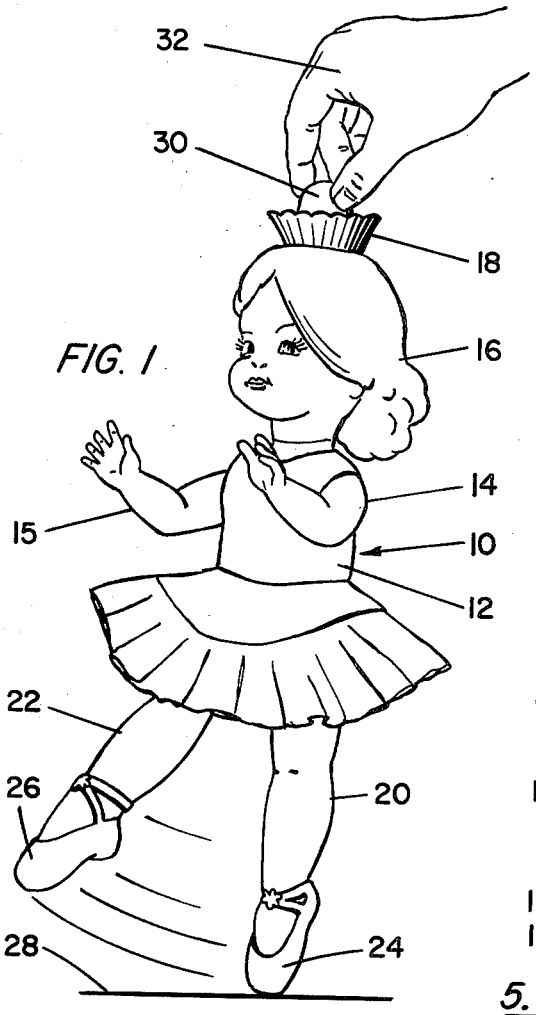
FIG. 1 is a perspective view of the animated ballerina doll according to the invention.

Referring now to the drawings, and more particularly to FIG. 1 there is shown a ballerina doll generally designated 10 having a torso 12 with arms 14 and 15 pivotally mounted thereto with an upwardly extending head member 16 having a simulated tiara or crown 18 on the top thereof. Depending downwardly from the torso 12 are first and second leg members 20 and 22, each of which terminates in a foot portion having the toes 24 and 26 respectively thereof extending downwardly in a position indicative of a ballet dancer. The toe 24 of the left leg 20 rests on a surface 28 with a control knob portion 30 of the crown 18 being held by the hand 32 of the child. As will hereinafter be described, with the child holding the control knob 30 and with the toe 24 engaged on the surface 28, the doll 10 can be rotated under control of motor driven means within the torso 12. During this rotation, by depression of the knob 30 the right leg 22 can be pivoted outwardly or rearwardly to simulate a kick during this rotation. With the motor inoperative, the leg 22 can still be pivoted to simulate a ballet kick by suitable depression of the control knob 30.

Figure 2:
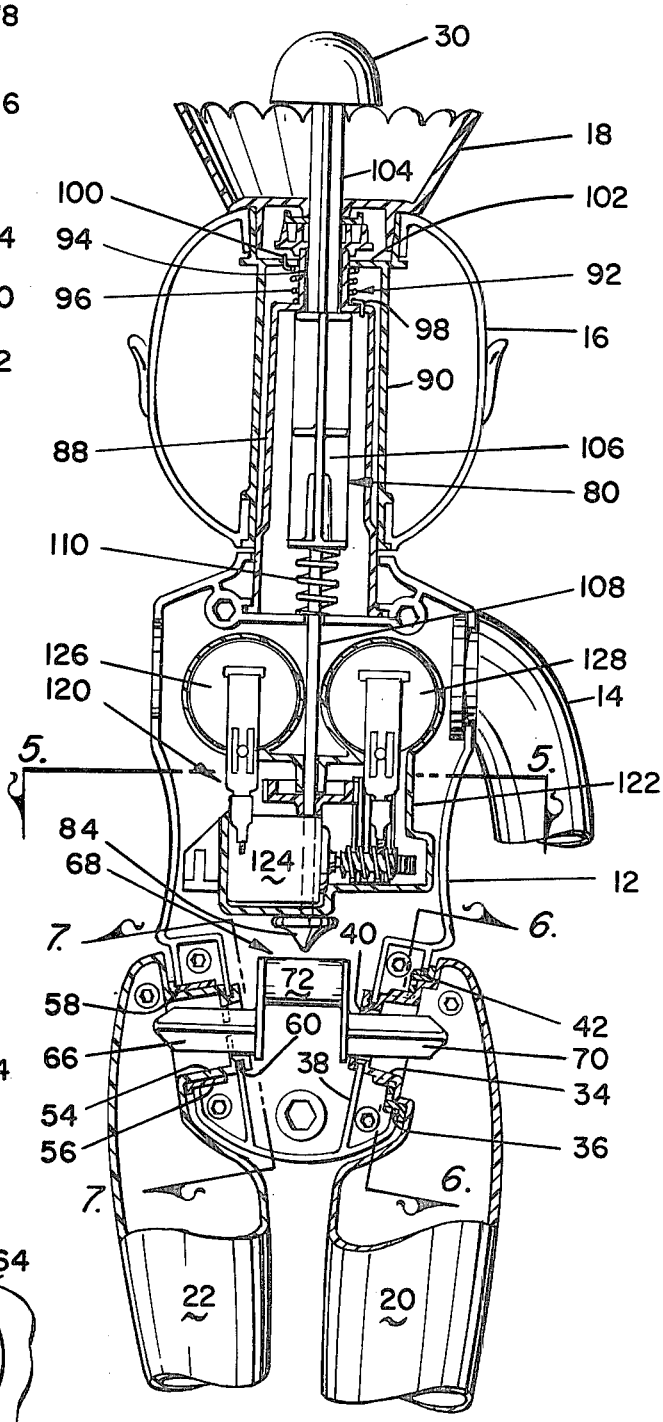
FIG. 2 is a front view of the doll of FIG. 1 with portions thereof in cross-section or broken away to illustrate the components therein.
Figure 6:
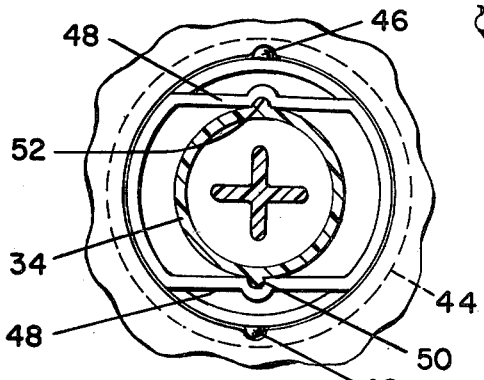
FIG. 6 is a cross-sectional view taken generally along line 6—6 of FIG. 2 illustrating the coupling of one leg.

Referring to FIGS. 2 and 6, left leg 20 of the doll 10 is mounted to the torso 12 so that it can be maintained in a fixed position with the leg 20 in general alignment with the longitudinal center line of the doll 10, that is, with the leg 20 depending on a generally vertical line. The leg 20 is formed of a substantially rigid material and at the upper end thereof is provided with a cup-shaped portion 34 which extends through an aperture 36 formed in the lower portion of torso 12. A partition 38 is formed on the interior of the torso 12 with an aligned aperture 40 frictionally engaging a circular recess on the inner end of cup-shaped portion 34. A detent sleeve 42 is interposed between the cup-shaped portion 34 and the adjacent planar surface surrounding aperture 36 of torso 12. As shown in FIG. 6, the detent sleeve 42 has a peripheral flange 44 abutting the outside surface adjacent aperture 36 with an inwardly extending tubular portion having a pair of aligned diametrically opposed protuberances 46 engaging cut outs formed in the periphery of aperture 36 to fixedly position the detent sleeve 42 relative to the torso 12. The detent sleeve 42 has integral therewith a pair of parallel resilient arm members 48, each of which is provided with a centrally located detent 50 adapted to engage a pair of protuberances 52 formed in the outer surface of cup-shaped portion 34 of leg 20. With the two protuberances 52 engaging the two detents 50 in the position illustrated in FIG. 6, the leg 20 will be maintained in a fixed position relative to torso 12 with the longitudinal center line of leg 20 extending generally vertical relative to the longitudinal center line of the torso 12.

Figure 7:
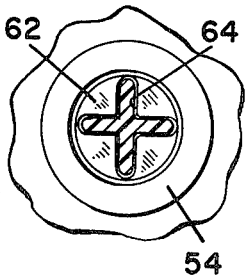
FIG. 7 is a cross-sectional view taken generally along line 7—7 of FIG. 2 illustrating the coupling of the other leg.
Figure 8:
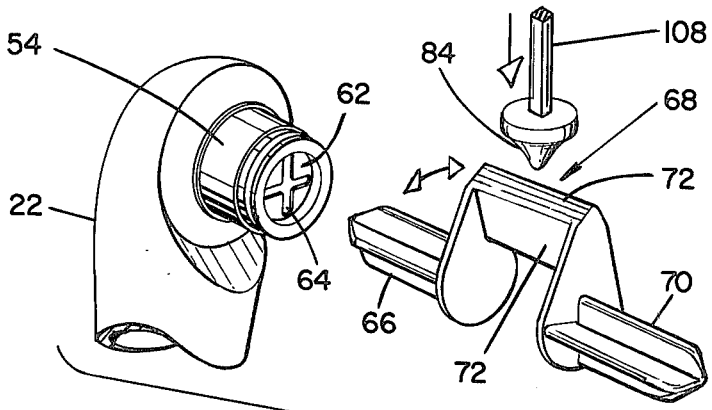
FIG. 8 is an exploded perspective view, partially broken away, depicting the leg-kicking mechanism.

Referring now to FIGS. 2, 7, and 8 the other leg member or right leg 22 is pivotally mounted to the lower portion of torso 12 by means of a cup-shaped portion 54 passing through a sleeve member 56 and thus through aligned apertures 58 and 60 formed in the torso for rotatively receiving the cup-shaped portion 54. No detent means are provided on the right leg 22. The inner portion of cup-shaped portion 54 of leg 22 is provided with a web member 62 having an X-shaped slot 64 formed therein. As also illustrated in FIG. 8, the slot 64 is configured for receiving a similarly configured section 66 of a crank member generally designated 68. The crank member 68 includes the shaft portion 66 which has a cross-section generally X-shaped, the shaft portion 66 being in general alignment with a second shaft portion 70. Intermediate the shaft portions 66 and 70 is a crank portion 72 having an upper edge 74 tapered downwardly on either side of the center thereof.

As shown in FIG. 2, with the crank member 68 having the shaft portion 66 thereof engaging the slot 64 in leg 22, and with leg 22 extending generally downwardly, the upper edge 74 of the crank portion 72 of crank member 68 has the center thereof disposed generally along the longitudinal center line of the torso 12 of the doll 10. The other shaft portion 70 of crank member 68 extends through an opening formed in the cup-shaped portion 34 of the other leg 20, this mounting being for stabilizing purposes only with shaft portion 70 being freely rotatable within the opening. As can be seen, the axis defined by the line running through shaft portions 66 and 70 is generally horizontal as is the upper edge 74 of crank portion 72.

Extending generally perpendicular to the midpoint of the upper edge 74 is an actuating member generally designated 80 which is positioned on the longitudinal center line of the doll 10 with one end thereof extending externally of the head 16 for receiving the control knob 30 which is affixed thereto. The other end of actuating member 80 has secured thereto a cam member 84 which has a generally conical surface with the apex thereof extending in proximity and generally centrally relative to the upper edge 74 of the crank portion 72 of crank member 68. As will hereinafter be described, and with brief reference to FIG. 3, the actuating member 80 is mounted for reciprocal movement on the longitudinal center line of the doll 10 with the lower point of cam 84 in alignment with the center of the upper edge 74 of crank portion 72. The normal position is illustrated in solid lines and as the control knob 30 is depressed downwardly to the dotted line position, the cam member 84 is depressed downwardly to the dotted line position for the point thereof to co-act with the tip or upper edge 74 of crank portion 72 thereby urging crank portion 72 clockwise as viewed in FIG. 3 to thereby elevate leg 22 to the dotted line position shown to simulate a kicking movement. The alignment of the tip of cam 84 will also permit leg 22 to be rotated in a counterclockwise position if the upper edge 74 of crank portion 72 is slightly to the left of the tip of cam member 84. This position will depend on whether or not the doll 10 is tipped slightly forward or slightly rearward relative to the force of gravity since the right leg 22, being freely rotatable, will tend to have an angular orientation relative to the torso depending on gravity. Thus, the actuating member 80 can be reciprocated to cause the cam 84 to cyclically engage the crank portion 72 of crank member 68 to swing or pivot leg 22 as desired by the child.

Referring again to FIG. 2, the upper portion of torso 12 has fixedly mounted thereto a tubular neck adapter 88 through which actuating member 80 extends. Secured within the head 16 is a head cylinder 90 of larger diameter than neck adapter 88 which is concentrically mounted relative thereto. A head spotting spring mechanism, generally designated 92, operatively interconnects the adapter 88 to the head cylinder 90. The upper portion 94 of neck adapter 88 is of smaller diameter and has a spring 96 encircling it, one end 98 of spring 96 being coupled through an aperture to the adapter 88 with the other end 100 of spring 96 being fixed within an aperture in a cross piece 102 of head cylinder 90. The actuating member 80 is provided with a pivot shaft portion 104 extending through the reduced diameter portion 94 of neck adapter 88. The actuating member 80 has an intermediate portion 106 of larger dimension than shaft portion 104 for positioning within the interior of neck adapter 88. Extending downwardly from the intermediate portion 106 is a splined or square rod portion 108 with the cam member 84 connected to the other end thereof. A spring member 110 may be utilized to bias the actuating member 80 upwardly, the spring 110 encircling the rod portion 108 between the intermediate portion 106 and a fixed partition 112 formed within the interior of torso 12.

Figure 4:
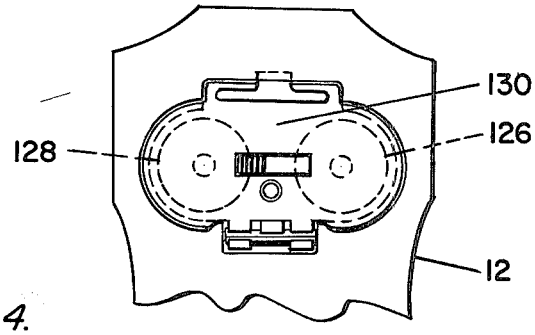
FIG. 4 is a partial rear view taken generally along line 4—4 of FIG. 3.

A motor drive mechanism generally designated 120 is secured within a housing 122 formed on the interior of torso 12 with a motor 124 mounted within housing 122 and electrically connected to a pair of batteries 126 and 128 positioned within compartments in housing 122. As seen in FIG. 4, the batteries are accessible through a battery compartment cover 130 formed in the rear of torso 12.

Figure 3:
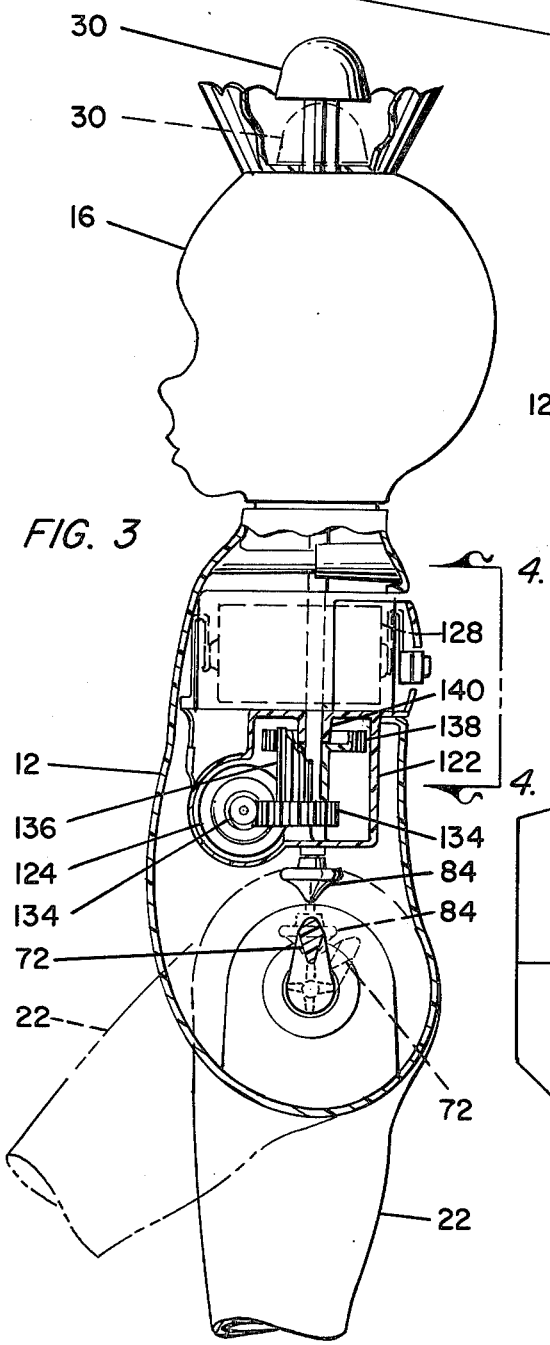
FIG. 3 is a side elevational view of the doll of FIG. 1 with portions thereof broken away or in cross-section to illustrate the internal components thereof, with the leg shown pivoted in dotted line.
Figure 5:
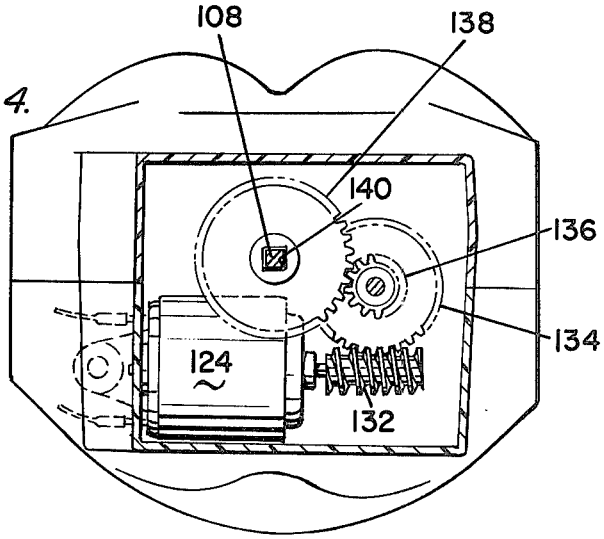
FIG. 5 is a cross-sectional view taken generally along line 5—5 of FIG. 2.

Referring to FIGS. 2, 3, and 5, the shaft of motor 124 is provided with a screw gear 132 which drives a spur gear 134 having a pinion portion 136 on it for rotation about a generally vertical axis. The pinion portion 136 co-acts with a drive gear 138 which is provided with a splined or square aperture 140 in the center thereof for receiving the splined or square rod portion 108 of the actuating member 80. As best illustrated in FIGS. 2 and 3, the pinion 136 of spur gear 134 is rather deep in the vertical dimension to maintain the drive gear 138 in contact therewith during depression of actuating member 80. The drive gear 138 essentially "floats" within housing 122 between the spur gear 134 and the journal boss 140 formed on the interior of housing 122, the rod portion 108 extending through the boss 140. With this particular arrangement, the spring 110 used to bias the control knob 30 to its upward position may be eliminated without detracting from the operation of the animated doll 10.

In operation, with the control knob 30 held in a fixed position and with motor 124 energized through conventional electrical connections to batteries 126 and 128, because of the splined rod portion 108 engaging the mating aperture within drive gear 138, as the motor rotates, drive gear 138 will remain stationary thereby turning the entire doll about the toe 24 of left leg 20. During this rotation, the child may reciprocate control knob 30 to thereby swing leg 22 as shown between solid lines and dotted lines in FIG. 3. The head spotting mechanism which is more fully shown and described in the above referenced U.S. Pat. No. 3,597,878, while not forming a part of the instant invention, enables the doll body or torso 12 to rotate through an angle of approximately ninety degrees while the head 16 remains in a fixed position. After the appropriate amount of rotation, the spring 96 enables the head 16 to be rotated in the direction of rotation abruptly to remain in that position for another ninety degree segment of travel.

For the use of the doll hereinabove described, without operating the motor 124, the child can detent the left leg 20 to its downward position, that is vertically in general alignment with the longitudinal center line of the torso 12, then position the toe 24 on a suitable surface and then reciprocate the control knob 30 to swing the leg 22 forward or backward depending upon the relation of crank portion 72 of crank member 68 relative to the cam member 84 at the time of contact. Similarly, with the motor 124 energized and the doll rotating, the control knob 30 can be reciprocated to thereby perform a swinging or kicking of leg 22. While there has been shown and described a preferred embodiment it is to be understood that various other adaptations and modifications may be made within the spirit and scope of the invention.

What is claimed is:

1. In a doll, the combination comprising:

a torso;

a head member mounted on said torso;

a first leg pivotally mounted on said torso;

detent means for fixedly positioning said first leg in general alignment with the longitudinal center line of said torso;

a second leg pivotally mounted on said torso;

a manually operable actuating member including a cam member movably reciprocably mounted within said torso, said actuating member including a cam member, said actuating member extending on the longitudinal center line of said doll through said head member and terminating with a knob which is manually depressible; and means including crank means configured to be engaged by said cam member coupled to said second leg within said torso and responsive to manipulation of said actuating member for pivoting said second leg with the toe of said first leg on a surface with said first leg detended whereby to simulate the movement of a balerina.

2. The combination according to claim 1 wherein said doll further includes a drive means mounted within said torso and said actuating member further includes a shaft portion driven by said drive means for rotating said doll about the toe of said second leg with said knob manually held in position.

3. The combination according to claim 2 wherein said drive means includes a motor mounted in fixed position within said torso and a drive gear driven by said motor, said drive gear being fixedly coupled to said shaft portion.

4. The combination according to claim 3 wherein said head member includes a simulated crown and said knob is configured to form a portion of said crown.

5. The combination according to claim 1 wherein said crank means is a crank member fixedly coupled to said second leg for pivoting the same.

6. In a doll, the combination comprising:

a torso;

a head mounted on said torso;

a first leg pivotally mounted on said torso;

means for fixedly positioning said first leg in general alignment with the longitudinal center line of said torso;

a second leg pivotally mounted on said torso;

drive means within said torso; and an actuating member reciprocably mounted within said torso on the longitudinal center line thereof and extending through said head, and having a knob portion, said actuating member being coupled to said drive means for rotating said doll about the toe of said second leg with knob portion manually held in position.

7. The combination according to claim 6 wherein said doll further includes means coupled to said second leg within said torso and responsive to reciprocation of said actuating member for pivoting said second leg.

8. The combination according to claim 7 wherein said means coupled to said second leg includes crank means.

9. The combination according to claim 8 wherein said actuating member includes cam means mounted on the end thereof opposite said knob portion for engaging said crank means for pivoting said second leg.

* * * * *